US005421912A

United States Patent [19]

Kumano et al.

[11] Patent Number: 5,421,912

[45] Date of Patent: Jun. 6, 1995

[54] METHOD OF PRODUCING NON-ORIENTED ELECTRICAL STEEL SHEET HAVING GOOD MAGNETIC PROPERTIES

[75] Inventors: Tomoji Kumano; Takeshi Kubota; Tadashi Nakayama; Hiroaki Masui, all of Kitakyushu; Yuji Yoshimura, Hikari, all of Japan

[73] Assignee: Nippon Steel Corporation, Tokyo, Japan

[21] Appl. No.: 213,999

[22] Filed: Mar. 15, 1994

Related U.S. Application Data

[63] Continuation of Ser. No. 929,516, Aug. 14, 1992, abandoned.

[30] Foreign Application Priority Data

| | | | |
|---|---|---|---|
| Aug. 14, 1991 | [JP] | Japan | 3-204419 |
| Aug. 14, 1991 | [JP] | Japan | 3-204420 |
| Aug. 14, 1991 | [JP] | Japan | 3-204421 |

[51] Int. Cl.[6] ..... H01F 1/147

[52] U.S. Cl. ..... 148/111; 148/120

[58] Field of Search ..... 148/111, 120

[56] References Cited

FOREIGN PATENT DOCUMENTS

| | | | |
|---|---|---|---|
| 54-76422 | 6/1979 | Japan . | |
| 57-198214 | 12/1982 | Japan . | |
| 2-182831 | 7/1990 | Japan | 148/111 |

*Primary Examiner*—John P. Sheehan
*Attorney, Agent, or Firm*—Wenderoth, Lind & Ponack

[57] ABSTRACT

A method of producing non-oriented electrical steel sheet comprising the steps of preparing steel comprising, by weight, up to 2.5% silicon, up to 1.0% aluminum and up to 2.5% (Si+2Al), with the remainder being iron and unavoidable impurities, hot rolling and cold rolling the steel to a final thickness and following this by finish annealing, wherein the average cooling rate between $Ar_3$ and $Ar_1$ during cooling transformation ($\gamma \rightarrow \alpha$) of the steel is controlled to be 50° C./s or less.

4 Claims, 3 Drawing Sheets

200μm

METHOD OF PRODUCING NON-ORIENTED ELECTRICAL STEEL SHEET HAVING GOOD MAGNETIC PROPERTIES

This application is a continuation of now abandoned application, Ser. No. 07/929,516, filed Aug. 14, 1992, now abandoned.

BACKGROUND OF THE INVENTION

1. Field of the Invention

The present invention relates to a method of producing non-oriented electrical steel sheet having high magnetic flux density and low core loss.

2. Description of the Prior Art

In recent years, the need to save energy has led to an increasing demand for higher quality non-oriented electrical steel sheet for use as the core material of small rotating machines. In response, manufacturers of electrical steel sheet have been conducting research and development into ways of improving the magnetic properties of non-oriented electrical steel sheet and have produced a number of low-grade non-oriented electrical steel sheets based on JIS specifications.

Conventionally various technical means have been employed to produce such low-grade non-oriented electrical steel sheets having low core loss values, including raising the purity of the steel during the melt step, increasing the silicon content, and using a sufficient temperature and time period during finish annealing.

However, a problem has been that while these techniques reduced the core loss values of the steel, at the same time the magnetic flux density also was reduced, limiting the degree of energy-saving that was possible.

SUMMARY OF THE INVENTION

An object of the present invention is therefore to provide a method of producing non-oriented electrical steel sheet that has low core loss together with high magnetic flux density.

BRIEF DESCRIPTION OF THE DRAWINGS

The objects and features of the present invention will become more apparent from a consideration of the following detailed description taken in conjunction with the accompanying drawings in which.

DETAILED DESCRIPTION OF THE INVENTION

Figure 1:
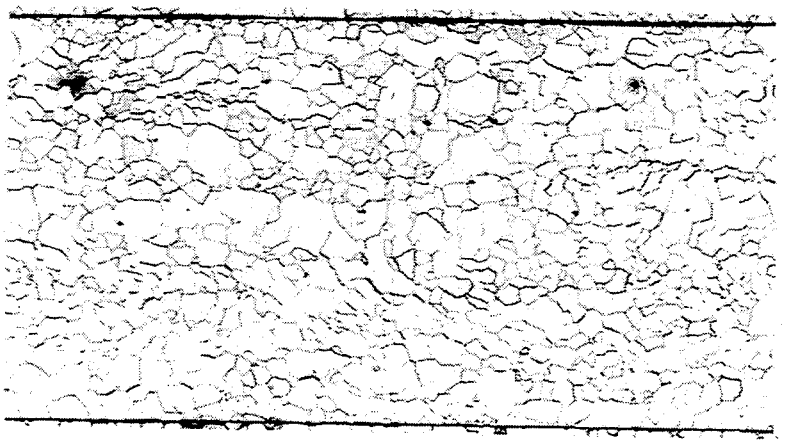
FIG. 1 is a photograph showing the crystalline structure of the final product of a comparative steel (cooled at a rate of 500° C./s)

By selecting suitable cooling conditions during the cooling transformation ($\gamma \rightarrow \alpha$) of non-oriented electrical steel sheet having phase transformation, the present inventors succeeded in controlling the texture of the product steel following finish annealing and thereby obtained a non-oriented electrical steel sheet that has high magnetic flux density and low core loss.

The process for obtaining non-oriented electrical steel sheet having high magnetic flux density and low core loss in accordance with the present invention comprises the steps of preparing a steel slab constituted of up to 2.5 wt % silicon, up to 1.0 wt % aluminum, and up to 2.5 wt % (Si+2Al), with the balance of Fe and unavoidable impurities, hot rolling and cold rolling the steel to the final thickness, and finish annealing, in which the cooling rate during cooling transformation ($\gamma \rightarrow \alpha$) is controlled to be 50° C./s or less.

The effect of the present invention is also obtained by including in the steel one or more elements selected from manganese, phosphorus, boron, nickel, chromium, antimony, tin, and copper for the purpose of improving the mechanical strength, magnetic properties, corrosion-resistance and other such properties of the product steel.

The object of the present invention can be attained with a carbon content of up to 0.0500%. The principle application of low-grade non-oriented electrical steel sheet is small rotating machines, and with respect to the stability of the magnetic properties, it is necessary that the magnetic properties of the non-oriented electrical steel sheet do not deteriorate during use (magnetic aging).

Because in accordance with the present invention the cooling rate during the cooling transformation $\gamma \rightarrow \alpha$ (the average cooling rate from the $Ar_3$ point to the $Ar_1$ point) is controlled to be 50° C./s or less (which cooling control shall hereinafter be referred to as "$\gamma$ processing"), there is sufficient precipitation of carbides, thereby reducing magnetic aging. As magnetic aging does not take place it is not necessary to use a very low carbon content but only to limit the carbon level to a maximum of 0.0500%.

Sulphur is an element that is unavoidably included when the steel melt is being prepared. Conventionally a sulphur content of up to 0.0100% is used, but since in the case of this invention the use of $\gamma$ processing makes it possible to mitigate the deleterious effect of the sulphur, a sulphur content of up to 0.020% can be used.

The nitrogen content should not exceed 0.010%. In conventional methods of producing non-oriented electrical steel sheet, as with sulphur, a high nitrogen content would give rise to temporary resolidification during the heating of the slab in the hot rolling process, resulting in the formation of precipitates such as AlN that would impede the growth of recrystallization grains during finish annealing and give rise to the pinning effect whereby movement of domain walls is obstructed during the magnetization of the steel, thereby becoming a factor in preventing the achievement of a low core loss value. For this reason, while nitrogen is conventionally limited to a maximum of 0.0050%, in the case of this invention in which the use of $\gamma$ processing makes it possible to mitigate the deleterious effect of the nitrogen, the nitrogen content may be up to 0.010%.

Silicon and aluminum are included to raise the specific resistance and reduce the eddy-current loss of the steel.

If (Si+2Al) exceeds 2.50% when the carbon content is 0.02% or less, transformation will not take place, hence the specified limitation of 2.50% for (Si+2Al).

Workability becomes degraded if the manganese content is less than 0.1%, and manganese is also added to mitigate the deleterious effect of sulphur. On the other hand, more than 2.0% manganese causes a marked drop in the magnetic flux density of the steel, hence the specified limit of 2.0%.

A phosphorus content of up to 0.1% improves the punchability of the steel. Up to 0.2% phosphorus may be included without impairment to the magnetic properties of the product steel.

Boron is added to mitigate the effect of nitrogen. A maximum boron content of 0.005% is specified to balance the nitrogen content. The use of $\gamma$ processing by this invention reduces the need to add boron.

The production conditions of the present invention will now be described. Cooling control during cooling transformation ($\gamma \rightarrow \alpha$) in accordance with the present invention, in which the steel melt is solidified on the moving wall for cooling to form direct cast strips, can be applied to cast strips during the $\gamma \rightarrow \alpha$ transformation. Reheating phase-transformation hot-rolled non-oriented electrical steel sheet (hereinafter also referred to as "transformation steel") to effect the transformation produces a random orientation of the crystal grains and a decrease in the grain size, and as such has been considered unsuitable as a way of improving the magnetic properties of the product steel and therefore has not been much employed.

This has also been the case with non-oriented electrical steel sheet production that includes the process of solidifying the steel on the surface of a rotating cooling body. However, assiduous research by the present inventors led to the discovery that the texture of the final product could be markedly improved by controlling the cooling rate during the cooling transformation ($\gamma \rightarrow \alpha$) of the cast strip, although the reasons for this are not as yet entirely clear. With this method, even if finish annealing is carried out at a higher temperature than the temperature used for finish annealing by the conventional processes and for a longer period in order to produce growth of the crystal grains and thereby enhance the core loss properties of the product steel, there is no drop in magnetic flux density.

In accordance with the present invention in which control of the cooling rate is used when the melt is cast to directly form strips (3.5 to 0.5 mm thick), as the means for cooling the cast strips at a rate of 50° C./s or less from the $Ar_3$ point to the $Ar_1$ point, it is preferable to use means for maintaining the temperature of the strip and also for applying some heating.

By providing for the temperature maintenance of strips formed into coils at a high temperature zone 50° C. or more above the $Ar_3$ point, the cast strip may be cooled at a rate of 50° C./s or less from the $Ar_3$ point to the $Ar_1$ point. Controlled cooling may also be used consisting of first cooling the strip fairly rapidly down to room temperature and reheating it to the $\gamma$ region, and then cooling it at a rate of 50° C./s or less from the $Ar_3$ point to the $Ar_1$ point.

Also in accordance with the present invention, by specifying the hot rolling conditions (high-temperature finishing, high-temperature coiling and the following gradual cooling) it becomes possible to control the texture in the product steel that has been finish annealed so as to thereby produce non-oriented electrical steel sheet that has a high magnetic flux density and a low core loss. This high-temperature finishing and high-temperature coiling is referred to as self-annealing and is disclosed by JP-A-54-10-76422/1979, for example.

Based on research by the present inventors and others, with respect to the hot rolling process in the case of $\gamma \rightarrow \alpha$ transformation non-oriented electrical steel sheet, a coiling temperature that is sufficiently higher than the $Ar_3$ point should be used together with a low cooling rate. Conventionally, in controlling the hot-rolling conditions of phase transformation in non-oriented electrical steel sheet the grain size of the hot-rolled sheet is controlled separately for each sheet according to whether the hot rolling is followed by annealing or not. However, so far there has been no attempt to effect $\gamma \rightarrow \alpha$ transformation by coiling at a high-temperature following the finish hot-rolling.

The reason for this is that it has been considered unsuitable for improving the magnetic properties of the product steel, because the cooling of the strip to effect the ($\gamma \rightarrow \alpha$) transformation produces a random orientation of the crystal grains and decreases the grain size of the hot-rolled sheet. In accordance with the method of this invention, however, the texture of the product steel can be improved by coiling the strip at a high temperature during the hot-rolling process and controlling the rate at which the strip is cooled during the course of the transformation.

The slowness of the cooling rate used during the self-annealing that follows the coiling in the hot-rolling process of this method, permits full precipitation of impurities that have low solubility in the $\alpha$ phase, so the growth of crystal grains during the finish annealing therefore is not impeded (the effect of the impurities is nullified). This means that it is possible to obtain a product that exhibits low core loss together with high magnetic flux density even when conventional finish annealing conditions are used.

As the high-temperature coiling and gradual cooling of this method are performed in the hot-rolling step, a material that has a low transformation point ($Ar_3$ point) is preferable. Materials that have a high transformation point ($Ar_3$ point) can be coiled at a temperature zone above the $Ar_3$ point by using a coiling reel provided directly downstream of the final stand of the hot-rolling line. However, in order to cool the material (strip coil) at an average rate of 50° C./s or less, after the coiling it may be necessary to provide the strip coil with a cover or a heating means. For securing better descaling (pickling) temperature-keeping of the material for the following descaling (pickling) process, the temperature-keeping cover is filled with an inert gas such as $N_2$. The steel is maintained at a $\gamma$ phase temperature (at or above the $Ar_3$ point) that varies according to the composition of the steel. Based on industry practice, 90 seconds at or above the $Ar_3$ point +50° C. and a cooling rate of 50° C./s or less from the $Ar_3$ point to the $Ar_1$ point are adequate.

With this method, furthermore, even if finish annealing is carried out at a higher temperature than the temperature used for finish annealing by the conventional processes and for a longer period in order to promote growth of the crystal grains and thereby enhance the core loss properties of the product steel, there is no deterioration of the magnetic flux density.

While the foregoing explanation relates to the use of a continuous hot-rolling mill, the invention can also be effectively applied in a reversing hot-rolling mill by conducting the same heat treatment.

In accordance with the present invention, moreover, the heat treatment is employed in the annealing prior to the final cold-rolling step to heat the material to the $\gamma$ region and effect transformation to the $\gamma$ phase, following which $\gamma$ processing is used in which a cooling rate of 50° C./s or less from the $Ar_3$ point to the $Ar_1$ point is applied to effect a retransformation of the material to the $\alpha$ phase.

This $\gamma$ processing may be carried out in a continuous annealing furnace or a box annealing furnace. In either case, in the heat treatment employed in the annealing prior to the final cold-rolling step it is necessary to heat the material to the $\gamma$ region and cool it at a cooling rate of 50° C./s or less to produce a retransformation of the material to the $\alpha$ phase. As such, when the hot-rolled sheet is cold-rolled to the final thickness with a one stage cold-rolling, in the hot-rolled sheet annealing step it is necessary to heat the material to the $\gamma$ region and then cool it at a cooling rate of 50° C./s or less to effect an $\alpha$ phase retransformation of the material.

On the other hand, when the hot-rolled sheet is cold-rolled to the final thickness using two stage cold-rolling separated by an intermediate annealing the need for the hot-rolled sheet annealing step is eliminated, as the material only needs to be heated to the $\gamma$ region and then cooled at 50° C./s or less to effect the $\alpha$ phase retransformation in the intermediate annealing step prior to the final cold-rolling.

The two-stage soaking annealing method used in the method of producing oriented electrical steel sheet disclosed by JP-A-57-198214/1982 may be used as the means for providing an average cooling rate of 50° C./s or less using a continuous annealing furnace. In the $\gamma$ processing of this method, the soaking is to be done at a temperature whereby the material assumes the $\gamma$ phase (i.e., a temperature equal to or higher than the $Ac_3$ point), which will vary according to the composition of the steel. According to industrial annealing (heat treatment) practice, 90 seconds at or above the $Ac_3$ point +50° C. is adequate, and for cooling the material from the $\gamma$ region to the $\alpha$ region, an average cooling rate of 50° C./s or less from the $Ar_3$ point to the $Ar_1$ point is adequate.

EXAMPLE 1

Melts having the compositions listed in Table 1 were solidified directly from molten steel on the two moving rolls for cooling to obtain strips 2.5 mm thick which were cooled from the $Ar_3$ point +50° C. to the $Ar_1$ point −50° C., using the following conditions.

Average cooling rates:

(1) 500° C./s (quenching into room temperature water);

(2) 50° C./s (air-cooling);

(3) 10° C./s (non-coiled, using a temperature-keeping cover during cooling);

(4) 1° C./s (coiled at $Ar_3$ point +50° C. or higher and then cooled as-is);

(5) 0.07° C./s (for cooling, coiled at $Ar_3$ point +50° C. or higher, temperature-keeping cover).

The strips were then pickled and cold-rolled to a thickness of 0.50 mm, degreased, and annealed for 30 seconds at 800° C. in a continuous annealing furnace. The magnetic properties were then measured (average of L+C; L: in the rolling direction; C: at 90° to L).

Table 2 shows the results thus obtained compared with steels obtained by the comparative methods, which were:

a) hot-rolled steel that is not annealed;

b) hot-rolled steel self-annealed for 2 hours after being coiled at 800° C. (JP-A-54-76422/1979);

c) the hot-rolled steel of method a) continuously annealed for 150 seconds at 925° C., and air cooled.

Figure 2:
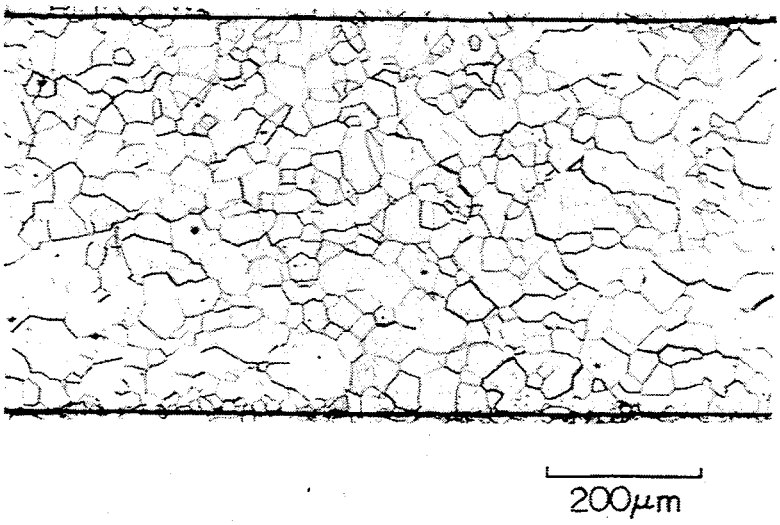
FIG. 2 is a photograph showing the crystalline structure of the final product according to the steel of the present invention (cooled at a rate of 0.07° C./s)

FIGS. 1 and 2 are photographs showing the phase structure after final annealing.

Although on a heat-by-heat basis the same final annealing conditions were used, steel subjected to $\gamma$ processing following final annealing showed larger crystal grains. (The Figures show steel 4 that has been subjected to $\gamma$ processing condition (1) (average cooling rate of 500° C./s) in the case of FIG. 1, and $\gamma$ processing condition (5) (0.07° C./s) in the case of FIG. 2.)

Thus, using the method of the present invention makes it possible to produce non-oriented electrical steel sheet that has good magnetic flux density and good core loss properties.

TABLE 1

(Wt %)

| | Composition | | | | | | | | |
|---|---|---|---|---|---|---|---|---|---|
| | C | Si | Mn | P | S | Al | N | B | Cr |
| 1 | 0.0038 | 1.11 | 0.31 | 0.010 | 0.0050 | 0.003 | 0.0020 | 0.0000 | 0.023 |
| 2 | 0.0045 | 1.05 | 0.16 | 0.005 | 0.0008 | 0.007 | 0.0027 | 0.0021 | 0.26 |
| 3 | 0.0031 | 0.53 | 0.51 | 0.048 | 0.0020 | 0.027 | 0.0021 | 0.0019 | 0.026 |
| 4 | 0.0025 | 0.28 | 0.34 | 0.079 | 0.0034 | 0.238 | 0.0019 | 0.0000 | 0.0027 |

TABLE 2

| | Comparative Methods Cooling rate (°C./s) conditions | | | | | | | |
|---|---|---|---|---|---|---|---|---|
| | a) Hot as-is | | b) Coiled at 800° C. and maintained for 2 hrs | | c) Cont. annealing for 150 s at 925° C. | | (1) 500° C./s | |
| Steel | W | B | W | B | W | B | W | B |
| 1 | 6.65 | 1.73 | 6.23 | 1.75 | 6.00 | 1.75 | 5.85 | 1.75 |
| 2 | 6.53 | 1.71 | 6.23 | 1.74 | 5.98 | 1.75 | 5.94 | 1.75 |
| 3 | 6.25 | 1.74 | 6.01 | 1.75 | 6.15 | 1.75 | 5.90 | 1.74 |
| 4 | 6.50 | 1.73 | 6.20 | 1.75 | 5.97 | 1.76 | 1.77 | 1.76 |

| | Invention Cooling rate (°C./s) conditions | | | | | | | |
|---|---|---|---|---|---|---|---|---|
| | (2) 50° C./s | | (3) 10° C./s | | (4) 1° C./s | | (5) 0.07° C./s | |
| Steel | W | B | W | B | W | B | W | B |
| 1 | 5.65 | 1.78 | 5.42 | 1.78 | 5.57 | 1.78 | 4.78 | 1.78 |
| 2 | 5.55 | 1.78 | 5.50 | 1.78 | 5.40 | 1.79 | 4.95 | 1.79 |
| 3 | 5.81 | 1.79 | 5.49 | 1.79 | 5.43 | 1.79 | 4.86 | 1.79 |
| 4 | 5.59 | 1.78 | 5.20 | 1.78 | 5.26 | 1.78 | 4.99 | 1.80 |

W: $W_{15/50}$ (W/kg); Core loss at a frequency of 50 Hz and a maximum magnetic flux density of 1.5 T (Telsa).
B: B50 (T); Magnetic flux density at magnetizing force of 5,000 A/m.
800° C. annealing for 30 s.

EXAMPLE 2

Silicon steel slabs having the compositions listed in Table 3 were heated by a normal method and hot-rolled at a finishing temperature of 1,050° C. to 950° C. to a thickness of 2.5 mm and then coiled at a temperature of 1,000° C. to 900° C. The coils were cooled from 1,000° C. to 850° C. at the following average cooling rates and conditions:

(i) 500° C./s (quenching in room-temperature water);
(2) 50° C./s (forced air-cooling);
(3) 10° C./s (air-cooling);
(4) 1° C./s (using temperature-keeping cover);
(5) 0.07° C./s (using application of weak heat in temperature-keeping cover).

The steels were then pickled and cold-rolled to a thickness of 0.50 mm, degreased, and annealed for 30 seconds at 800° C. in a continuous annealing furnace. The magnetic properties were then measured (average of L+C; L: in the rolling direction; C: at 90° to L).

Table 4 shows the results thus obtained compared with steels obtained by the comparative methods, which were:

a) hot-rolled steel that is not annealed;
b) hot-rolled steel self-annealed for 2 hours after being coiled at 800° C. (JP-A-54-76422/1979);
c) the hot-rolled steel of method a) continuously annealed for 150 seconds at 925° C., and air cooled.

Figure 3:
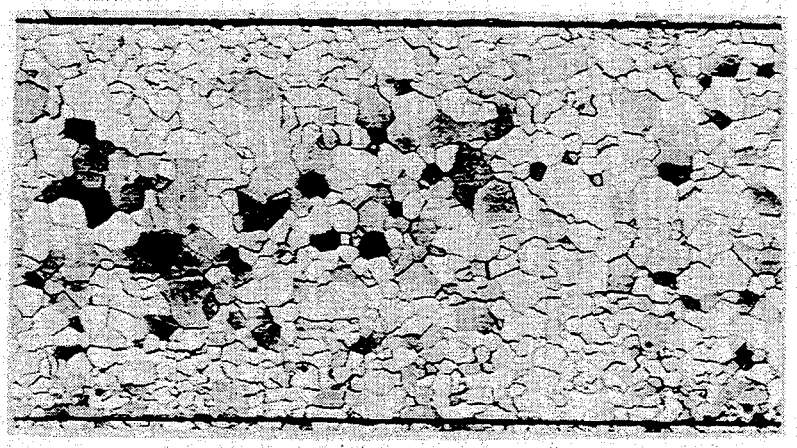
FIG. 3 is a photograph showing the crystalline structure of the final product of a comparative steel (cooled at a rate of 500° C./s)
Figure 4:
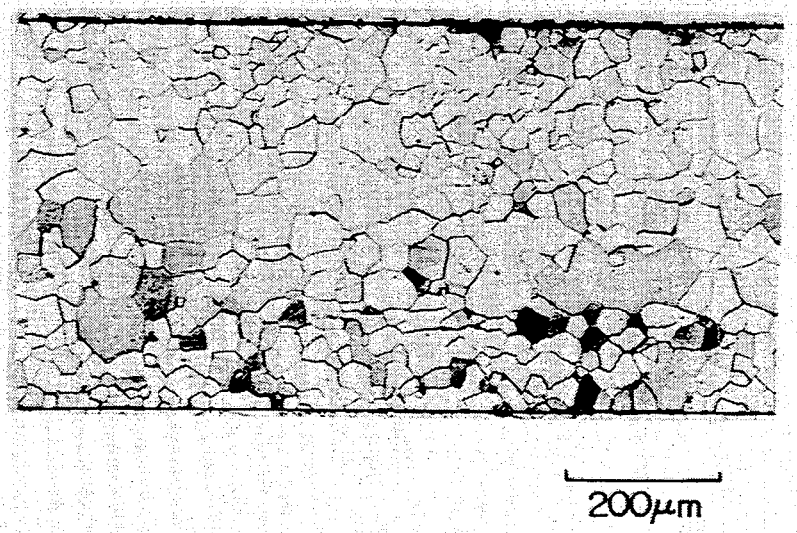
FIG. 4 is a photograph showing the crystalline structure of the final product according to the steel of the present invention (cooled at a rate of 0.07° C./s)

FIGS. 3 and 4 are photographs showing the phase structure after final annealing.

Although on a heat-by-heat basis the same final annealing conditions were used, steel subjected to high-temperature self-annealing following final annealing showed larger crystal grains. (The Figures show steel 8 that following high-temperature self-annealing has been subjected to the average cooling rate condition (1) of 500° C./s (FIG. 3 and the γ processing condition (5) of 0.07° C./s) (FIG. 4)).

Thus, using the method of the present invention makes it possible to produce non-oriented electrical steel sheet that has good magnetic flux density as well as good core loss properties.

TABLE 3

(Wt %)

| | Composition | | | | | | | |
|---|---|---|---|---|---|---|---|---|
| | C | Si | Mn | P | S | Al | N | B |
| 5 | 0.0050 | 1.09 | 0.15 | 0.013 | 0.0047 | 0.030 | 0.0025 | 0.0000 |
| 6 | 0.0045 | 1.05 | 0.25 | 0.020 | 0.0062 | 0.035 | 0.0027 | 0.0020 |
| 7 | 0.0045 | 0.55 | 0.55 | 0.060 | 0.0035 | 0.027 | 0.0025 | 0.0020 |
| 8 | 0.0045 | 0.25 | 0.35 | 0.078 | 0.0039 | 0.285 | 0.0020 | 0.0000 |

TABLE 4

| | Comparative Methods | | | | | | | |
|---|---|---|---|---|---|---|---|---|
| | Cooling rate (°C./s) conditions | | | | | | | |
| | a) Hot as-is | | b) Coiled at 800° C. and maintained for 2 hrs | | c) Cont. annealing for 150 s at 925° C. | | (1) 500° C./s | |
| Steel | W | B | W | B | W | B | W | B |
| 5 | 6.60 | 1.72 | 6.13 | 1.75 | 6.01 | 1.75 | 5.85 | 1.75 |
| 6 | 6.45 | 1.71 | 6.25 | 1.74 | 5.99 | 1.75 | 5.95 | 1.75 |
| 7 | 6.15 | 1.74 | 6.05 | 1.75 | 6.18 | 1.75 | 5.93 | 1.74 |
| 8 | 6.45 | 1.73 | 6.15 | 1.75 | 5.85 | 1.76 | 6.10 | 1.76 |

| | Invention | | | |
|---|---|---|---|---|
| | Cooling rate (°C./s) conditions | | | |
| | (2) | (3) | (4) | (5) |

TABLE 4-continued

| | 50° C./s | | 10° C./s | | 1° C./s | | 0.07° C./s | |
|---|---|---|---|---|---|---|---|---|
| Steel | W | B | W | B | W | B | W | B |
| 5 | 5.55 | 1.78 | 5.48 | 1.78 | 5.57 | 1.78 | 4.75 | 1.78 |
| 6 | 5.40 | 1.78 | 5.50 | 1.78 | 5.35 | 1.79 | 4.50 | 1.79 |
| 7 | 5.61 | 1.79 | 5.55 | 1.79 | 5.55 | 1.79 | 4.97 | 1.79 |
| 8 | 5.40 | 1.78 | 5.58 | 1.78 | 5.47 | 1.78 | 4.92 | 1.80 |

W: $W_{15/50}$ (W/kg); Core loss at a frequency of 50 Hz and a maximum magnetic flux density of 1.5 T (Telsa).
B: B50 (T); Magnetic flux density at magnetizing force of 5,000 A/m.
800° C. annealing for 30 s.

EXAMPLE 3

Silicon steel slabs having the compositions listed in Table 4 were heated by a normal method and hot-rolled to a thickness of 2.5 mm.

As a first set of conditions (Conditions 1)), the hot-rolled steels were subjected to continuous annealing at 1,100° C. for 2 minutes, then cooled at the following average cooling rates and conditions:

(1) 500° C./s (quenching in room-temperature water);
(2) 50° C./s (air-cooling);
(3) 10° C./s (two-stage soaking);
(4) 1° C./s (two-stage soaking).

In accordance with a second set of conditions (Conditions 2)), the steels were cooled using a cooling rate condition (5) of 0.07° C./s by box-annealing at 1,100° C. for 10 minutes followed by intermediate cooling in the furnace after the furnace had been switched off.

The steels were then pickled and cold-rolled to a thickness of 0.50 mm, degreased, and annealed for 30 seconds at 800° C. in a continuous annealing furnace. The magnetic properties were then measured (average of L+C; L: in the rolling direction; C: at 90° to L).

Table 6 shows the results thus obtained compared with steels obtained by the comparative methods, which were:

a) hot-rolled steel that is not annealed;
b) hot-rolled steel self-annealed for 2 hours after being coiled at 800° C. (JP-A-54-76422/1979);
c) the hot-rolled steel of method a) continuously annealed for 150 seconds at 925° C., and air cooled.

Figure 5:
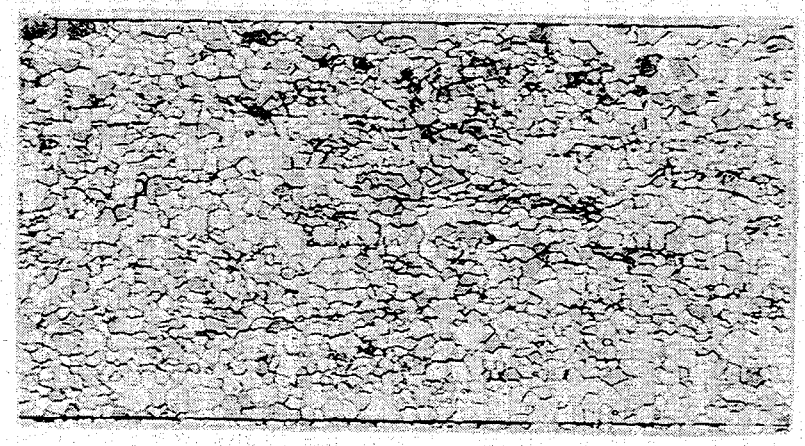
FIG. 5 is a photograph showing the crystalline structure of the final product of a comparative steel (cooled at a rate of 500° C./s)
Figure 6:
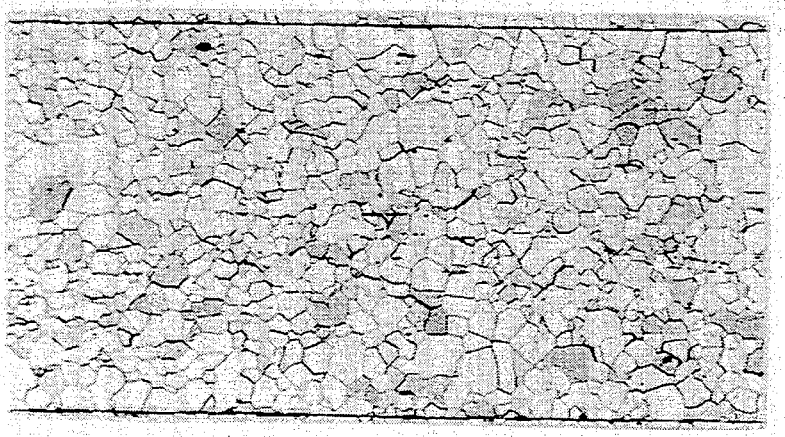
FIG. 6 is a photograph showing the crystalline structure of the final product according to the steel of the present invention (cooled at a rate of 0.07° C./s).

FIGS. 5 and 6 are photographs showing the phase structure after final annealing.

Although on a heat-by-heat basis the same final annealing conditions were used, steel subjected to γ processing following final annealing showed larger crystal grains. (The Figures show steel 12 that has been subjected to γ processing condition (1) (average cooling rate of 500° C./s) in the case of FIG. 5, and γ processing condition (5) (0.07° C./s) in the case of FIG. 6.)

Thus, using the method of the present invention makes it possible to produce non-oriented electrical steel sheet that has good magnetic flux density and good core loss properties.

TABLE 5

(Wt %)

| | Composition | | | | | | | |
|---|---|---|---|---|---|---|---|---|
| | C | Si | Mn | P | S | Al | N | B |
| 9 | 0.0035 | 1.11 | 0.17 | 0.010 | 0.0057 | 0.028 | 0.0019 | 0.0000 |
| 10 | 0.0040 | 1.07 | 0.14 | 0.012 | 0.0074 | 0.032 | 0.0017 | 0.0018 |
| 11 | 0.0055 | 0.57 | 0.50 | 0.050 | 0.0030 | 0.025 | 0.0026 | 0.0022 |
| 12 | 0.0017 | 0.26 | 0.30 | 0.071 | 0.0029 | 0.294 | 0.0023 | 0.0000 |

TABLE 6

Comparative Methods

TABLE 6-continued

| | Cooling rate (°C./s) conditions | | | | | | | |
|---|---|---|---|---|---|---|---|---|
| | a) Hot as-is | | b) Coiled at 800° C. and maintained for 2 hrs | | c) Cont. annealing for 150 s at 925° C. | | (1) 500° C./s | |
| Steel | W | B | W | B | W | B | W | B |
| 9 | 6.65 | 1.73 | 6.23 | 1.75 | 6.00 | 1.75 | 5.95 | 1.75 |
| 10 | 6.53 | 1.71 | 6.23 | 1.74 | 5.98 | 1.75 | 5.90 | 1.75 |
| 11 | 6.25 | 1.74 | 6.01 | 1.75 | 6.15 | 1.75 | 6.00 | 1.74 |
| 12 | 6.50 | 1.73 | 6.20 | 1.75 | 5.97 | 1.76 | 6.12 | 1.76 |

Invention

| | Cooling rate (°C./s) conditions | | | | | | | |
|---|---|---|---|---|---|---|---|---|
| | (2) 50° C./s | | (3) 10° C./s | | (4) 1° C./s | | (5) 0.07° C./s | |
| Steel | W | B | W | B | W | B | W | B |
| 9 | 5.60 | 1.78 | 5.38 | 1.78 | 5.47 | 1.78 | 4.65 | 1.78 |
| 10 | 5.45 | 1.78 | 5.40 | 1.78 | 5.45 | 1.79 | 4.90 | 1.79 |
| 11 | 5.71 | 1.79 | 5.35 | 1.79 | 5.35 | 1.79 | 4.77 | 1.79 |
| 12 | 5.50 | 1.78 | 5.25 | 1.78 | 5.27 | 1.78 | 4.87 | 1.80 |

W: $W_{15/50}$ (W/kg); Core loss at a frequency of 50 Hz and a maximum magnetic flux density of 1.5 T (Telsa).
B: B50 (T); Magnetic flux density at magnetizing force of 5,000 A/m.
800° C. annealing for 30 s.

We claim:

1. A method of producing non-oriented electrical steel sheet comprising the steps of:

preparing a steel slab comprising, by weight, up to 2.5% silicon, up to 1.0% aluminum and up to 2.5% (Si+2Al), with the remainder being iron and unavoidable impurities;

hot rolling and cold rolling the steel to a final thickness; and finish annealing the steel after cold rolling;

wherein the steel forms a gamma phase by being heated to the gamma region immediately prior to the step of cold rolling to a final thickness, and the average cooling rate from $Ar_3$ to $Ar_1$ during cooling transformation ($\gamma \rightarrow \alpha$) of the steel is controlled to be 50° C./s or less.

2. The method according to claim 1 wherein the steel in the form of a strip, after hot rolling, is coiled at a temperature equal to or higher than the $Ar_3$ point, and after the strip has been coiled, and is maintained at the gamma region from the $Ar_3$ point to the $Ar_1$ point an average cooling rate of 50° C./s or less is used to cool the coil and effect a transformation to the $\alpha$ phase.

3. A method of producing non-oriented electrical steel sheet comprising the steps of:

preparing a steel melt comprising, by weight, up to 2.5% silicon, up to 1.0% aluminum and up to 2.5% (Si+2Al), with the remainder being iron and unavoidable impurities;

forming the steel melt into a cast strip by solidification of the steel melt on a moving wall for cooling;

cold rolling the cast strip to a final thickness; and finish annealing the steel after cold rolling;

wherein the steel forms a gamma phase immediately prior to the step of cold rolling to a final thickness, and a step of cooling from $Ar_3$ to $Ar_1$ at an average cooling rate of 50° C./s or less is conducted, with respect to the cast strip formed by solidification of the steel melt on a moving wall for cooling, during the course of $\gamma \rightarrow \alpha$ cooling transformation of the cast strip.

4. A method of producing non-oriented electrical steel sheet comprising the steps of:

preparing a steel slab comprising, by weight, up to 2.5% silicon, up to 1.0% aluminum and up to 2.5% (Si+2Al), with the remainder being iron and unavoidable impurities;

hot rolling and cold rolling the steel to a final thickness; and finish annealing the steel after cold rolling;

wherein annealing is conducted prior to the cold rolling to a final thickness, which annealing includes a heat treatment step in which the steel is heated to the $\gamma$ region and transformed to the $\gamma$ phase, and then, from the $Ar_3$ point to the $Ar_1$ point, an average cooling rate of 50° C./s or less is used to cool the steel and effect a retransformation of the steel to the $\alpha$ phase.

* * * * *